US011297437B1

(12) United States Patent
Campbell

(10) Patent No.: US 11,297,437 B1
(45) Date of Patent: Apr. 5, 2022

(54) RIBBON MICROPHONE

(71) Applicant: Tyler Campbell, Ann Arbor, MI (US)

(72) Inventor: Tyler Campbell, Ann Arbor, MI (US)

( * ) Notice: Subject to any disclaimer, the term of this patent is extended or adjusted under 35 U.S.C. 154(b) by 0 days.

(21) Appl. No.: 17/128,274

(22) Filed: Dec. 21, 2020

(51) Int. Cl.
*H04R 9/02* (2006.01)
*H04R 9/04* (2006.01)
*H04R 9/08* (2006.01)

(52) U.S. Cl.
CPC ..... *H04R 9/048* (2013.01); *H04R 9/08* (2013.01)

(58) Field of Classification Search
CPC ..... H04R 9/048; H04R 2307/027
See application file for complete search history.

(56) References Cited

U.S. PATENT DOCUMENTS 2,552,311 A 5/1951 Duncan
2,572,376 A * 10/1951 Olson ..... H04R 1/222 381/345
2,673,251 A * 3/1954 Duncan ..... H04R 9/048 381/176
4,395,592 A * 7/1983 Colangelo ..... H04R 9/048 181/151
4,550,228 A * 10/1985 Walker ..... H04R 7/18 381/186
4,580,014 A * 4/1986 Hobrough ..... H04R 9/048 381/399
5,195,143 A * 3/1993 Spiegel ..... H04R 9/048 181/164
5,212,736 A * 5/1993 Tsukagoshi ..... H04R 9/048 381/190
7,430,297 B2 * 9/2008 Akino ..... H04R 7/14 381/176
8,275,156 B2 * 9/2012 Akino ..... H04R 9/048 381/176
8,331,588 B2 * 12/2012 Akino ..... H04R 9/048 381/176
9,078,061 B2 * 7/2015 Shimura ..... H04R 5/027
9,369,802 B2 * 6/2016 Akino ..... H04R 5/027
9,668,057 B1 * 5/2017 Jayne ..... H04R 7/14
9,800,979 B2 * 10/2017 Ghaffari ..... H04R 9/08
(Continued)

FOREIGN PATENT DOCUMENTS

CH 314504 A * 6/1956 ..... H04R 9/048
FR 926074 A * 9/1947 ..... H04R 9/048
GB 742006 A * 12/1955 ..... H04R 1/38

*Primary Examiner* — Ryan Robinson
(74) *Attorney, Agent, or Firm* — Donald J. Ersler

(57) ABSTRACT

An improved ribbon microphone preferably includes a housing tube and a microphone assembly. The microphone assembly includes a ribbon transducer, a reflector bar, a first magnet, a second magnet, a upper ribbon retainer and a lower ribbon retainer. The housing tube includes at least one audio aperture. The ribbon transducer includes a thin strip of metal with an embossed non-linear pattern formed therein. The lower ribbon retainer is the same as upper ribbon retainer, but turned upside down. The ribbon retainer includes a retainer base and a ribbon clamp. The retainer base includes a clamp slot to receive the ribbon clamp. Each end of the ribbon transducer is retained between the ribbon clamp and the retainer base. Opposing ends of magnets and reflector bar are retained in the upper and lower ribbon retainer. An upper end cap and a lower end cap capture the microphone assembly within the housing tube.

20 Claims, 11 Drawing Sheets

(56) References Cited

U.S. PATENT DOCUMENTS

| | | | | |
|---|---|---|---|---|
| 9,820,026 | B2 * | 11/2017 | Akino | H04R 1/083 |
| 10,405,104 | B1 * | 9/2019 | Abel | H04R 19/04 |
| 10,721,552 | B1 * | 7/2020 | Cloud | H04R 9/048 |
| 2006/0078152 | A1 * | 4/2006 | Royer | H04R 9/048 381/399 |
| 2011/0286619 | A1 * | 11/2011 | Short, III | H04R 9/048 381/355 |
| 2016/0198265 | A1 * | 7/2016 | Timmins | H04R 9/048 381/91 |

* cited by examiner

RIBBON MICROPHONE

BACKGROUND OF THE INVENTION

1. Field of the Invention

The present invention relates generally to audio reproduction and more specifically to an improved ribbon microphone, which includes an improved strength ribbon transducer and a reflector element.

2. Discussion of the Prior Art

It appears that the prior art does not teach or suggest a ribbon transducer with an embossed non-linear corrugation pattern similar to a herringbone design along a length of the ribbon transducer. The herringbone pattern is an improvement over an angled pattern, because the herringbone pattern is more rigid and less prone to breaking under blasts of air. Further, it appears that the prior art does not teach or suggest a reflector element being located behind a back of the ribbon transducer. The reflector bar provides improved high frequency response relative to the prior art ribbon microphones. Further, the ribbon microphone may be rotated 180 degrees. A sound wave approaching from a back of the ribbon microphone will travel around the reflector bar to vibrate the ribbon transducer and produce a more rolled-off sound. It is advantageous to provide a ribbon microphone with two different sound properties. U.S. Pat. No. 2,552,311 to Duncan discloses a ribbon support for high fidelity electro-acoustical sound transducers. U.S. Pat. No. 9,668,057 to Jayne discloses a ribbon transducer.

Accordingly, there is a clearly felt need in the art for an improved ribbon microphone, which includes an improved strength ribbon transducer and a reflector element, which creates two different sound recording properties, depending upon its orientation.

SUMMARY OF THE INVENTION

The present invention provides an improved ribbon microphone, which includes two different sound recording properties. The improved ribbon microphone preferably includes a housing tube and a microphone assembly. The microphone assembly preferably includes a ribbon transducer, a reflector bar, a first magnet, a second magnet, a upper ribbon retainer and a lower ribbon retainer. The housing tube includes at least one audio aperture. An audio mesh tube is retained in an inner perimeter of the housing tube to cover the at least one audio aperture. The ribbon transducer includes a thin strip of metal. An embossed non-linear corrugated pattern similar to a herringbone design is pressed into a length of the ribbon transducer. The herringbone design includes a first segment extending from a second segment at a middle of the ribbon transducer. An angle between the first and second segments is preferably obtuse, but could be acute. The first and second segments preferably extend to opposing edges of the ribbon transducer. A flat portion is created on opposing ends of the ribbon transducer for clamping thereof in the upper and lower ribbon retainers. The lower ribbon retainer is the same as upper ribbon retainer, but turned upside down.

The ribbon retainer preferably includes a retainer base and a ribbon clamp. The retainer base includes a clamp slot, a first magnet pocket, a second magnet pocket, and a reflector pocket. The clamp slot is formed in a top of the retainer base. The clamp slot is sized to receive the ribbon clamp. The first magnet pocket, the second lower magnet pocket and reflector pocket are formed in a bottom of the retainer base. The first magnet pocket is sized to firmly receive one end of the first magnet. The second magnet pocket is sized to firmly receive one end of the second magnet. The reflector pocket is sized to firmly receive end of the reflector bar. A ribbon opening is formed through the center of the retainer base.

The ribbon clamp preferably includes an outer semi-circular shape and an inner semi-circular shape. A pair of fastener holes are formed through the ribbon clamp. A pair of fasteners are inserted through the pair of fastener holes. Conductive tape is wrapped around a wall of straight portion of the ribbon clamp. The conductive tape makes electrical contact with an end of the ribbon transducer. A wire is soldered to the conductive tape. An inner edge of the ribbon clamp is used to clamp one end of the ribbon transducer against a wall of the clamp slot to secure the one end of the ribbon transducer.

An upper end cap is preferably engaged with a top of the upper ribbon retainer. A lower end cap is preferably engaged with a bottom of the lower ribbon retainer. A plurality of upper fastener holes are formed through a side wall of the housing tube at a top thereof and a plurality of lower fastener holes are formed through the side wall of the housing tube near a bottom thereof. A plurality of fasteners are screwed into the upper end cap and the lower end cap to axially retain the upper and lower ribbon retainers in the housing tube. A transformer is retained in the housing tube below the lower end cap. Opposing ends of the upper and lower wires are connected to inputs of the transformer. Outputs of the transformer are connected to an electrical connector.

Accordingly, it is an object of the present invention to provide an improved ribbon microphone, which includes an improved strength ribbon transducer.

Finally, it is object of the present invention to provide an improved ribbon microphone, which creates two different sound recording properties, depending upon its orientation.

These and additional objects, advantages, features and benefits of the present invention will become apparent from the following specification.

DETAILED DESCRIPTION OF THE PREFERRED EMBODIMENTS

Figure 1:
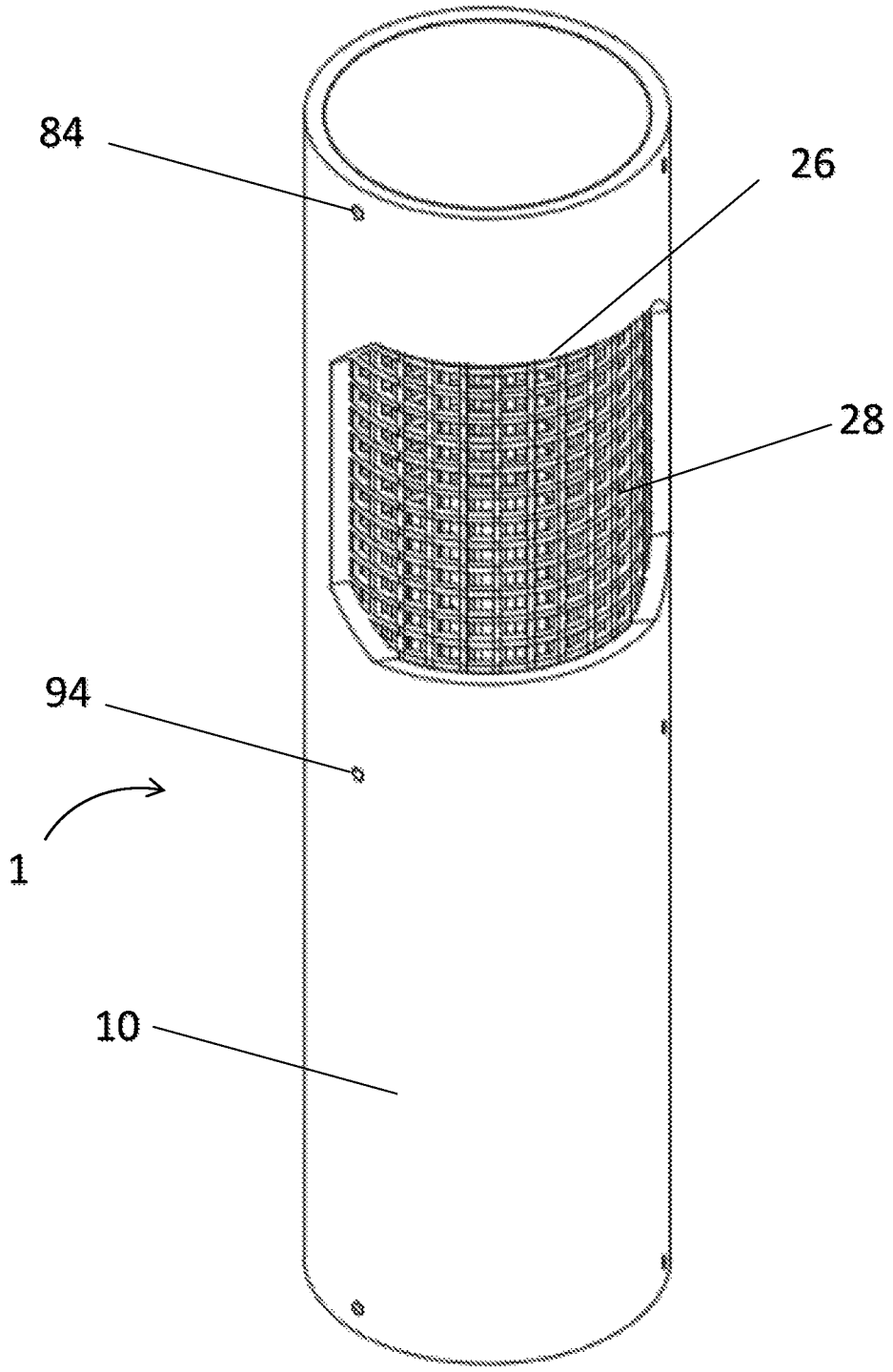
FIG. 1 is a perspective view of an improved ribbon microphone in accordance with the present invention.
Figure 2:
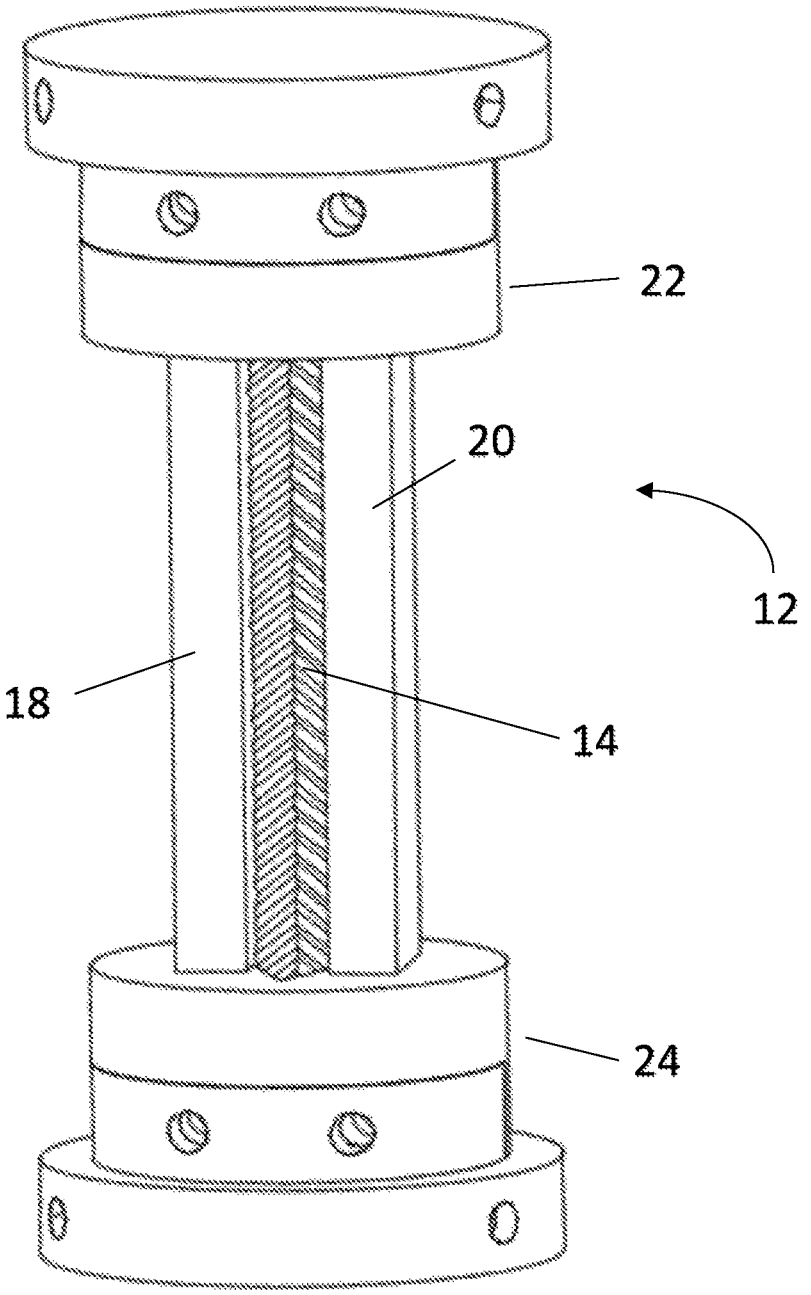
FIG. 2 is a perspective view of a microphone assembly of an improved ribbon microphone in accordance with the present invention.

With reference now to the drawings, and particularly to FIG. 1, there is shown a perspective view of an improved ribbon microphone 1. With reference to FIG. 2, the improved ribbon microphone 1 preferably includes a housing tube 10 and a microphone assembly 12. The microphone assembly 12 preferably includes a ribbon transducer 14, a reflector bar 16, a first magnet 18, a second magnet 20, an upper ribbon retainer 22 and a lower ribbon retainer 24. The housing tube 10 includes at least one audio aperture 26. An audio mesh tube 28 is retained in an inner perimeter of the housing tube 10 to cover the at least one audio aperture 26. The audio mesh tube 28 prevents dust and saliva from contacting the ribbon transducer 14. A second audio aperture may be located behind the first audio aperture 26. Recording from the second audio aperture would produce a different tonal balance than recording from the first audio aperture 26.

Figure 12:
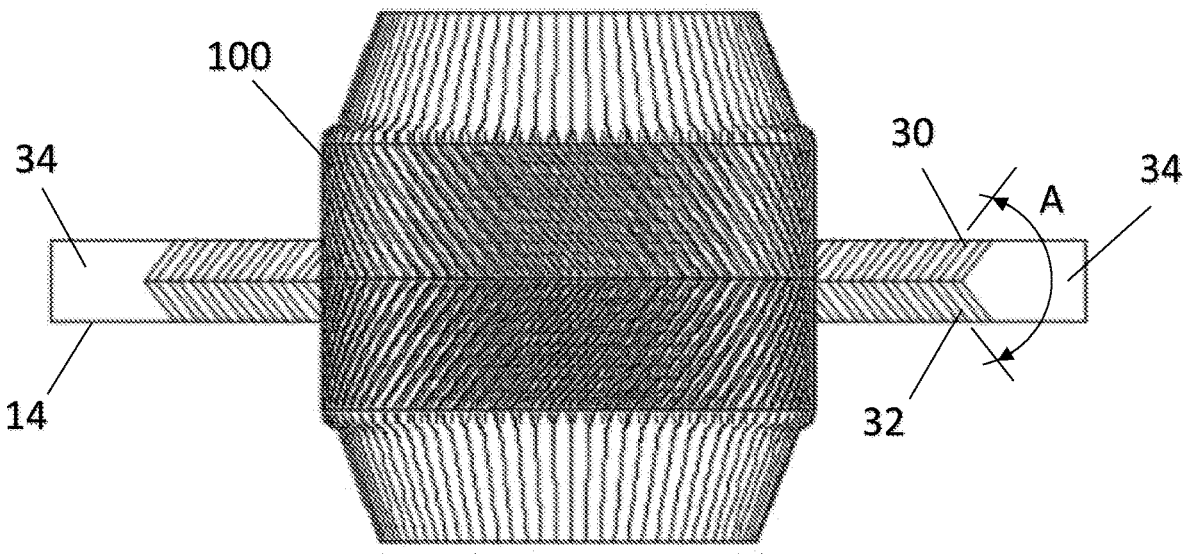
FIG. 12 is a top view of a herringbone gear being used to create a herringbone pattern in a ribbon transducer of a microphone assembly of an improved ribbon microphone in accordance with the present invention.
Figure 12A:
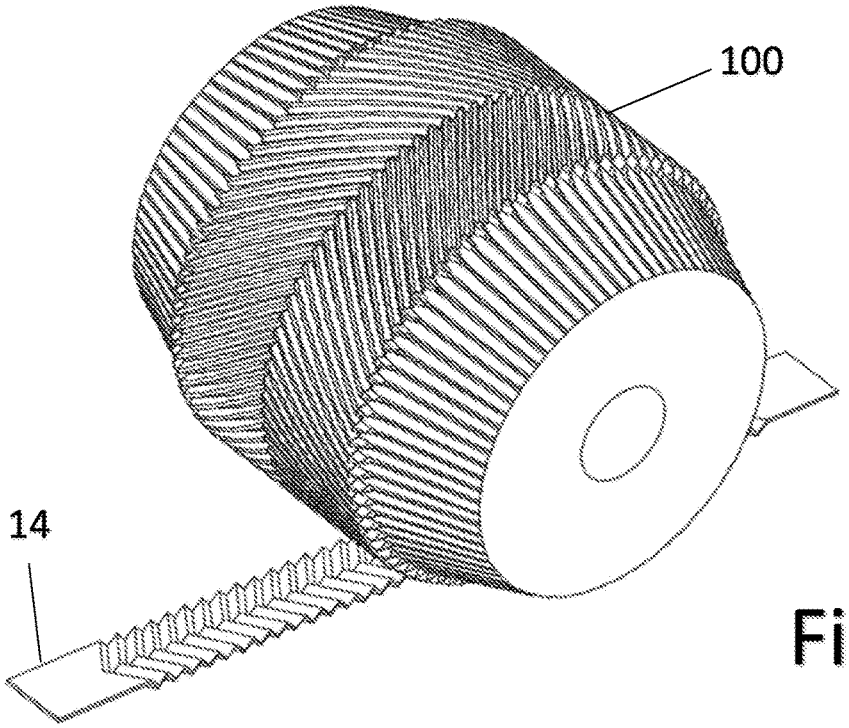
FIG. 12*a* is a perspective view of a herringbone gear being used to create a herringbone pattern in a ribbon transducer of a microphone assembly of an improved ribbon microphone in accordance with the present invention.
Figure 13:
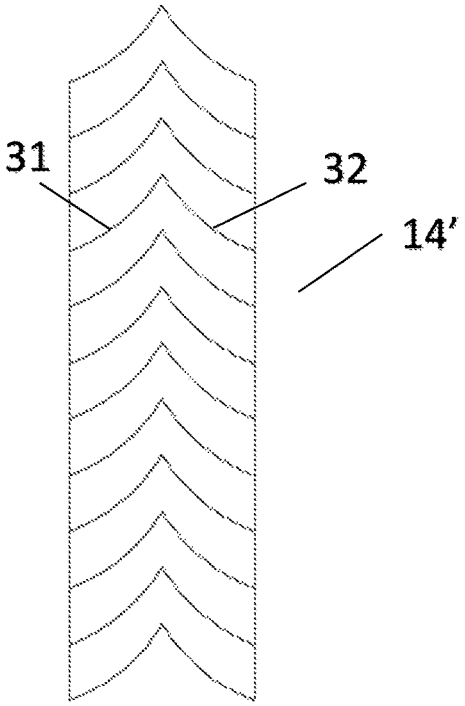
FIG. 13 is a top view of a portion of a first alternative embossed ribbon transducer design with curved line segments of an improved ribbon microphone in accordance with the present invention.
Figure 14:
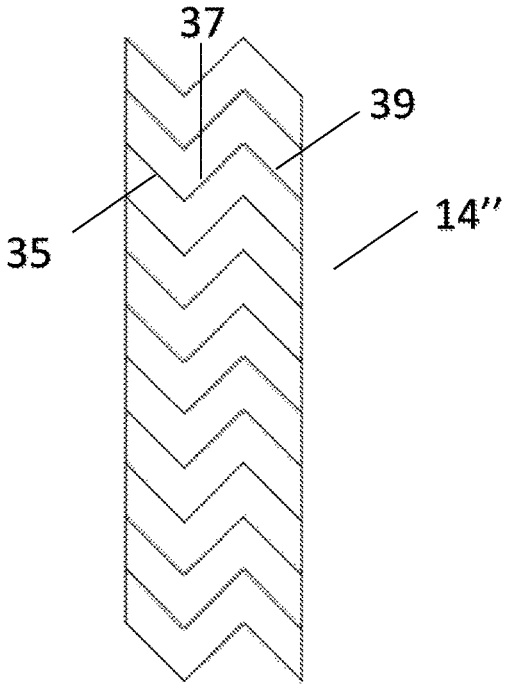
FIG. 14 is a top view of a portion of a second alternative embossed ribbon transducer design with three angled line segments of an improved ribbon microphone in accordance with the present invention.
Figure 15:
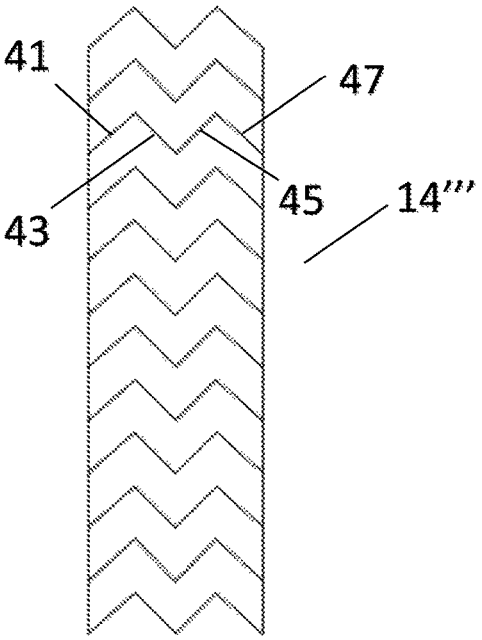
FIG. 15 is a top view of a portion of a third alternative embossed ribbon transducer design with four angled line segments of an improved ribbon microphone in accordance with the present invention.
Figure 16:
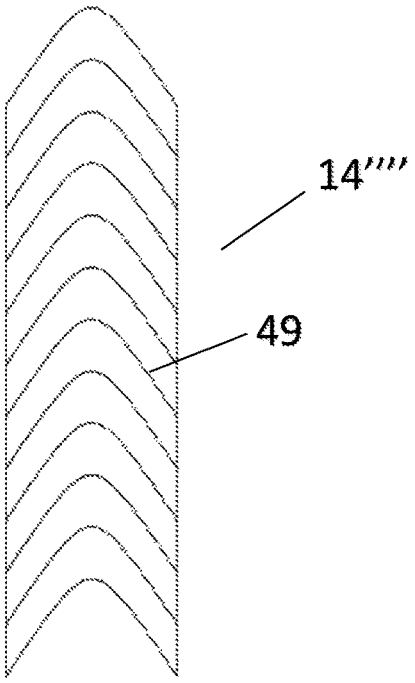
FIG. 16 is a top view of a portion of a fourth alternative embossed ribbon transducer design with parabolic segments of an improved ribbon microphone in accordance with the present invention.

The ribbon transducer 14 includes a thin strip of metal. With reference to FIGS. 12-12*a*, a herringbone design is pressed into a length of the ribbon transducer 14 with a herringbone gear 100 pressing against a support surface or a second herringbone gear. The herringbone design includes a plurality of first segments 30 extending from a plurality of second segments 32 at a middle of the ribbon transducer 14. An angle "A" between the plurality of first and second segments is preferably obtuse but could be acute. The first and second segments 30, 32 preferably extend to opposing edges of the ribbon transducer 14. With reference to FIG. 14, a ribbon transducer 14" includes a plurality of first segments 35 extending from a plurality of second segments 37 and a plurality of third segments 39 extending from an opposing end of the plurality of second segments 37. Segments 35, 37 and 39 are angled relative to each other. With reference to FIG. 15, a ribbon transducer 14''' includes a plurality of first segments 41, a plurality of second segments 43, a plurality of third segments 45 and a plurality of fourth segments 47. Segments 41, 43, 45 and 47 are angled relative to each other. However, the plurality of segments do not have to be in contact with each other. With reference to FIG. 16, a ribbon transducer 14'''' includes a plurality of parabolic segments 49. A flat portion 34 is created on opposing ends of the ribbon transducer 14 for clamping thereof in the upper and lower ribbon retainers 22 and 24. The lower ribbon retainer 24 is the same as upper ribbon retainer 22 but turned upside down. The first and second magnets 18, 20 are preferably neodymium N52 and have the shape of rectangular bars, but other types of magnets and shapes may also be used.

With reference to FIGS. 3-6, the ribbon retainer 22, 24 preferably includes a retainer base 36 and a ribbon clamp 38. The retainer base 36 includes a clamp slot 40, a first magnet pocket 42, a second magnet pocket 44 and a reflector pocket 46. The clamp slot 40 is formed in a top of the retainer base 36. The clamp slot 40 is sized to receive the ribbon clamp 38. The first magnet pocket 42, the second magnet pocket 44 and the reflector pocket 46 are formed in a bottom of the retainer base 36. The first magnet pocket 42 is sized to firmly receive one end of the first magnet 18. The second magnet pocket 44 is sized to firmly receive one end of the second magnet 20. The reflector pocket 46 is sized to firmly receive one end of the reflector bar 16. The reflector bar 16 creates a unique acoustic effect, whether located behind the ribbon transducer 14, or in front of the ribbon transducer 14. A ribbon opening 48 is formed through the center of the retainer base 36, between the first and second magnet pockets 42, 44. A wire groove 50 is preferably formed in a top of the retainer base 36 to provide clearance for an electrical wire 52. Two anti-rotation projections 54 are preferably formed in a top of the retainer base 36. A pair of tapped holes 56 may be formed in a side wall 58 of the clamp slot 40.

Figure 3:
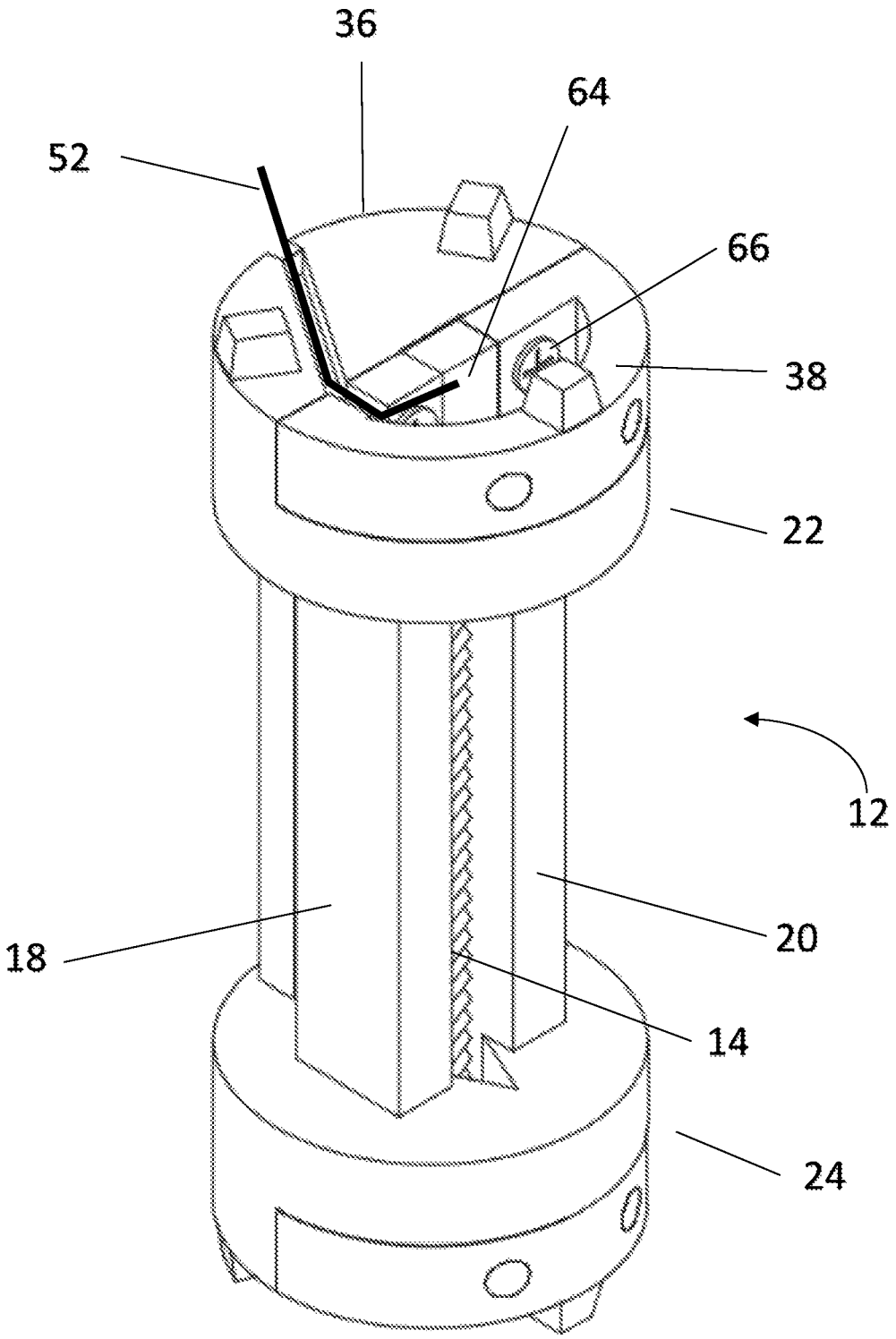
FIG. 3 is a top perspective view of a microphone assembly of an improved ribbon microphone in accordance with the present invention.
Figure 4:
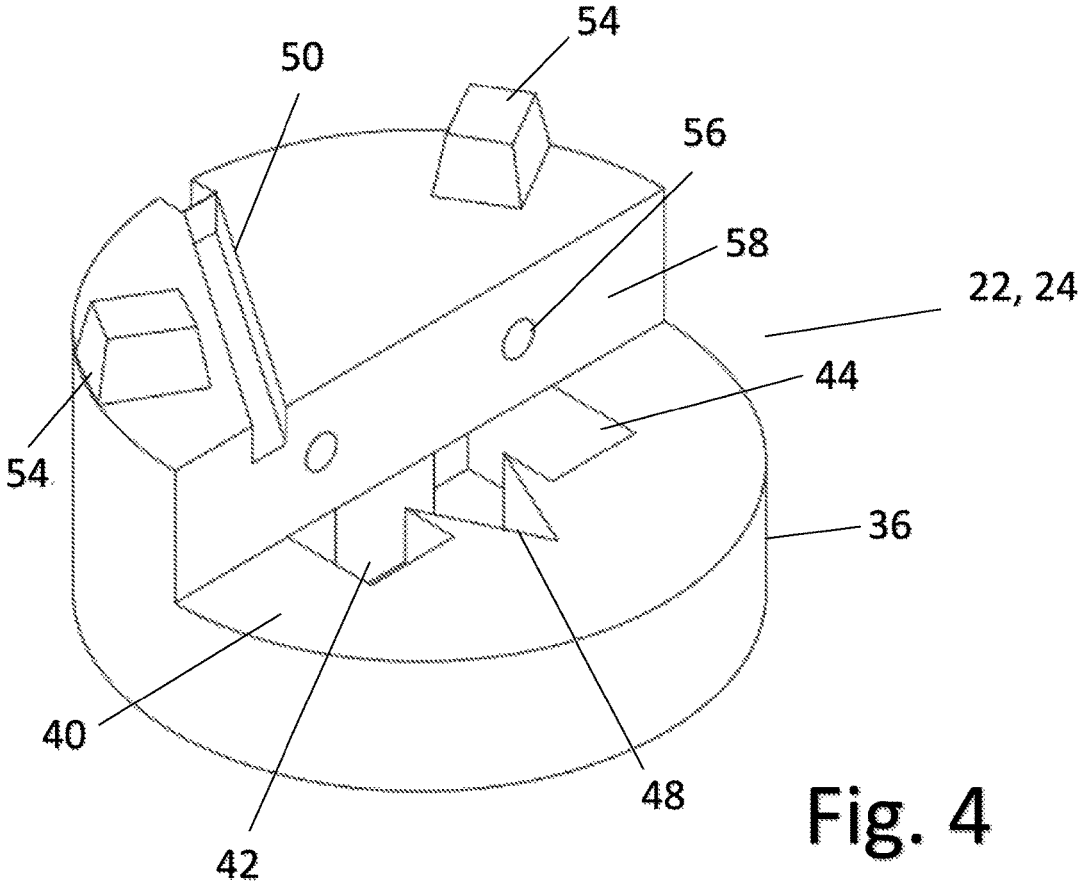
FIG. 4 is a top perspective view of a retainer base of an improved ribbon microphone in accordance with the present invention.
Figure 5:
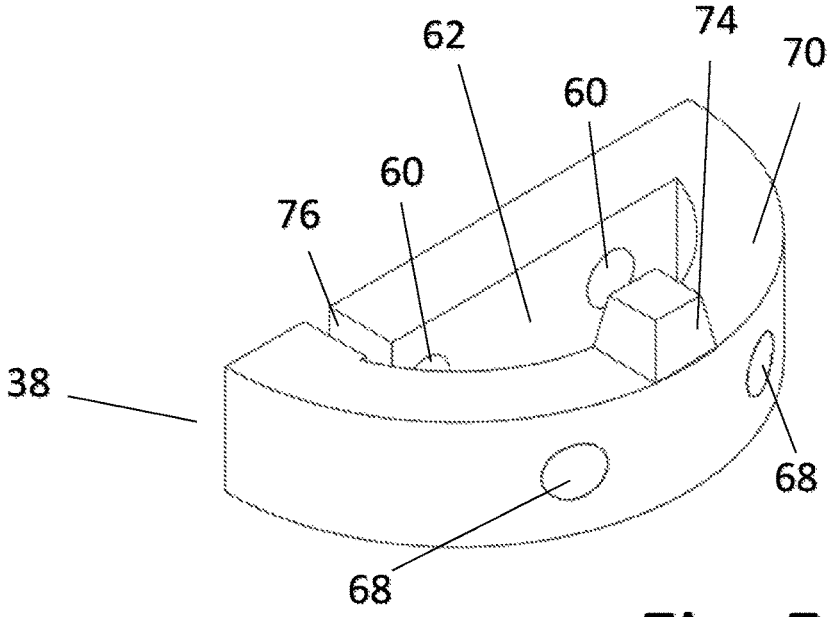
FIG. 5 is a top perspective view of a ribbon clamp of an improved ribbon microphone in accordance with the present invention.
Figure 6:
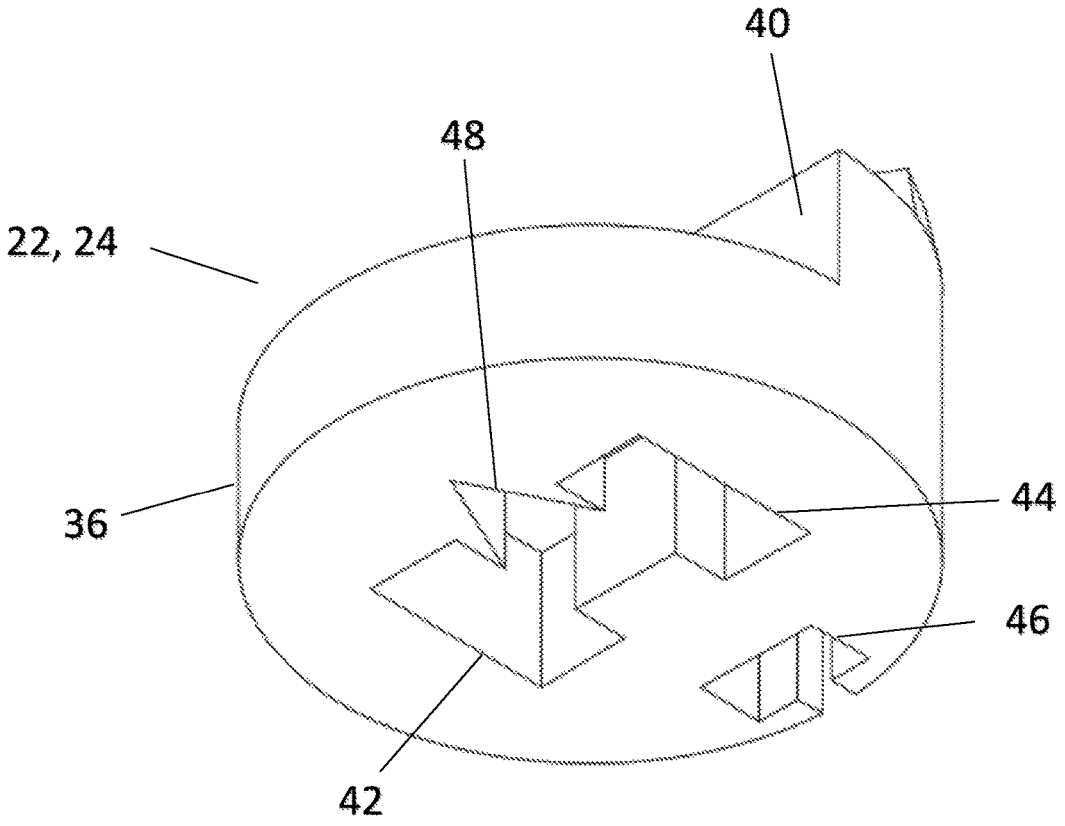
FIG. 6 is a bottom perspective view of a retainer base of an improved ribbon microphone in accordance with the present invention.
Figure 7:
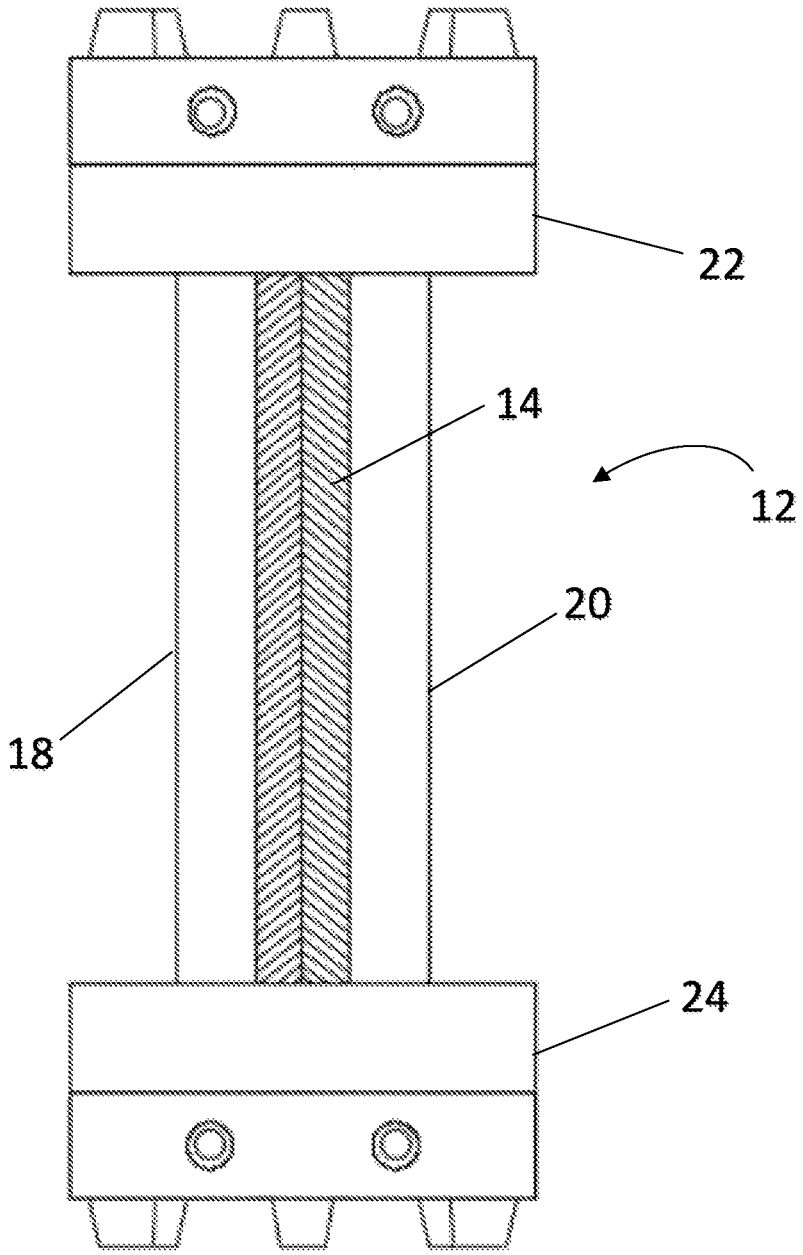
FIG. 7 is a front view of a microphone assembly of an improved ribbon microphone in accordance with the present invention.
Figure 8:
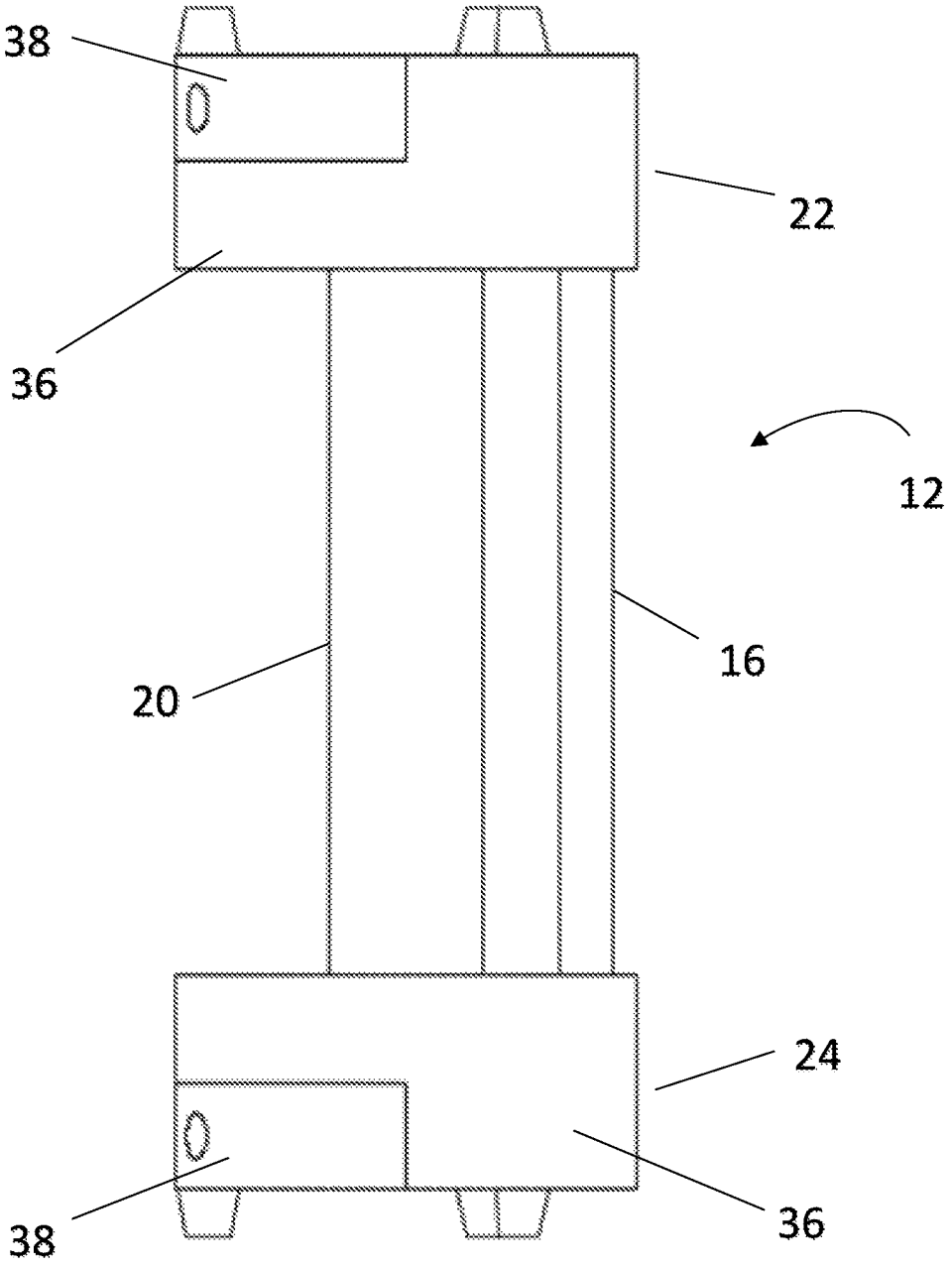
FIG. 8 is a side view of a microphone assembly of an improved ribbon microphone in accordance with the present invention.
Figure 9:
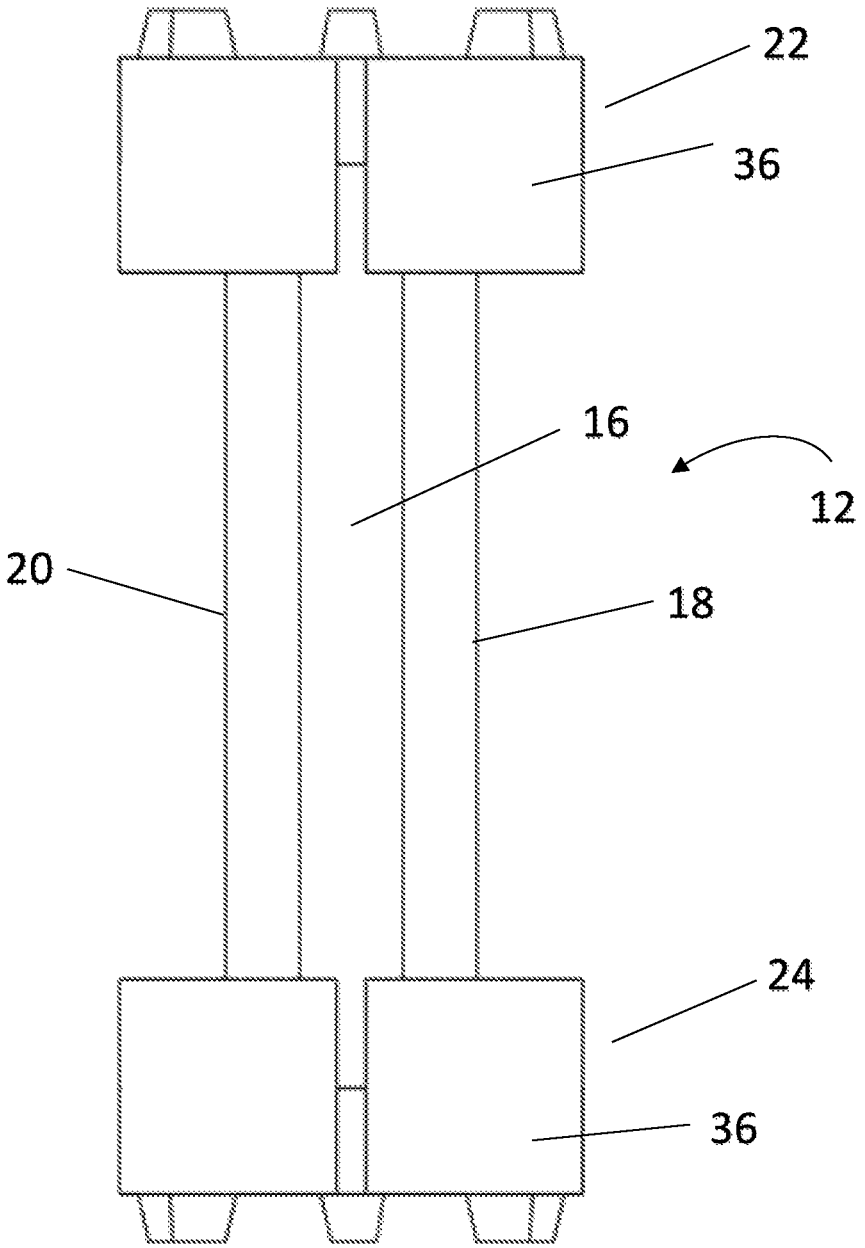
FIG. 9 is a rear view of a microphone assembly of an improved ribbon microphone in accordance with the present invention.

The ribbon clamp 38 preferably includes a semi-circular shape and an inner semi-circular shape. A pair of fastener holes 60 are formed through a straight wall 62 of the ribbon clamp 38. An opposing wall 70 extends from opposing ends of the straight wall 62. Conductive tape 64 is wrapped around the straight wall 62 of the ribbon clamp 38. The conductive tape 64 makes electrical contact with the ribbon transducer 14. A pair of fasteners 66 are inserted through the pair of fastener holes 60 and threaded into the pair of tapped holes 56 to secure one end of the ribbon transducer 14 between the side wall 58 of the retainer base 36 and the straight wall 62 of the ribbon clamp 38. A pair of fastener access holes 68 are formed through an opposing wall 70 of the ribbon clamp 38 to allow the pair of fasteners 66 to be tightened. With reference to FIG. 3, a wire 52 is soldered to the conductive tape 64. An anti-rotation projection 74 extends from a top of the opposing wall 70. A slit 76 may be used to allow the opposing wall 70 to be pulled away from the straight wall 62 to insert the pair of fasteners 66 into the pair of fastener holes 60.

Figure 10:
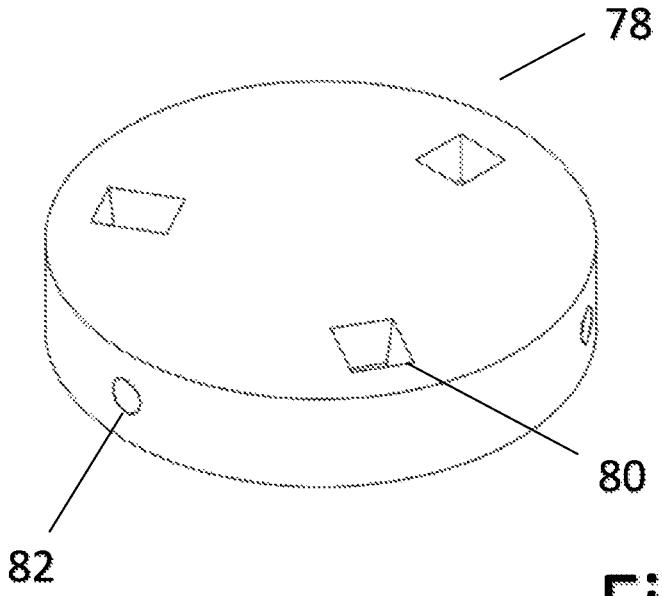
FIG. 10 is a bottom perspective view of a top end cap of an improved ribbon microphone in accordance with the present invention.
Figure 11:
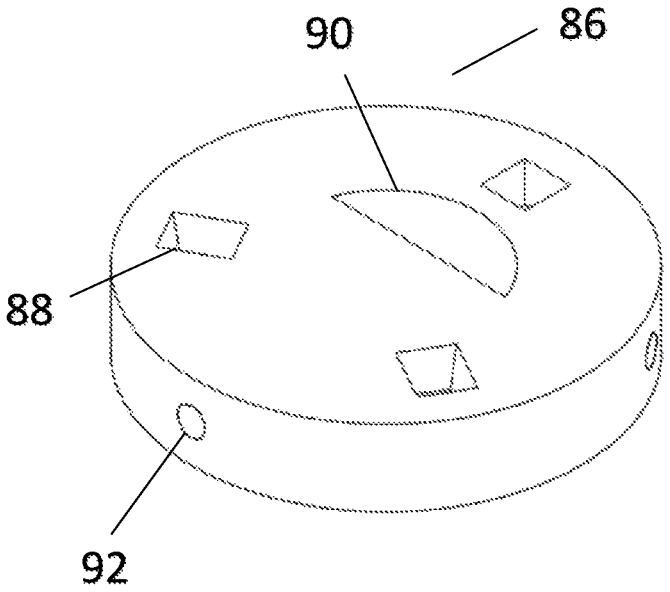
FIG. 11 is a bottom perspective view of a bottom end cap of an improved ribbon microphone in accordance with the present invention.

With reference to FIG. 10, an upper end cap 78 is preferably engaged with a top of the upper ribbon retainer 22. The upper end cap 78 includes a plurality of projection pockets 80, which are sized to receive the anti-rotation projections 54, 74. A plurality of tapped holes 82 are formed around a perimeter of the upper end cap 78. The upper end cap 78 is retained in the housing tube 10 by tightening a plurality of upper fasteners 84. With reference to FIG. 11, a lower end cap 86 is preferably engaged with a bottom of the lower ribbon retainer 24. The lower end cap 86 includes a plurality of projection pockets 88, which are sized to receive the anti-rotation projections 54, 74.

The upper and lower ribbon end caps 78, 86 prevent axial movement of the microphone assembly 12 within the housing tube 10. A wire through hole 90 is formed through the lower end cap 86 to provide clearance for two wires 52 connected to opposing ends of the ribbon transducer 14. A plurality of tapped holes 92 are formed around a perimeter of the lower end cap 86. The lower end cap 86 is retained in the housing tube 10 by tightening a plurality of upper fasteners 94. A transformer (not shown) is retained in the housing tube 10 below the lower end cap 86. Opposing ends of the upper and lower wires 52 are connected to inputs of the transformer. Outputs of the transformer are connected to an electrical connector.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An improved ribbon microphone, comprising:

a housing tube; and a microphone assembly includes a ribbon transducer, a first magnet, a second magnet, an upper ribbon retainer and a lower ribbon retainer, at least two different pluralities of line segments are pressed into a length of said ribbon transducer, said ribbon transducer is fabricated from a single strip of material, two of said at least two different pluralities of line segments are angled relative to each other, said first magnet is positioned on one edge of said ribbon transducer, said second magnet is positioned on an opposing edge of said ribbon transducer, a bottom of said first magnet, said ribbon transducer and said second magnet are retained in said lower ribbon retainer, a top of said first magnet, said ribbon transducer and said second magnet are retained in said upper ribbon retainer, said microphone assembly is retained inside said housing tube.

2. The improved ribbon microphone of claim 1 wherein:

at least one audio aperture is formed through a sidewall of said housing tube.

3. The improved ribbon microphone of claim 2 wherein:

an audio mesh tube is inserted into an inner perimeter of said housing tube to cover said at least one audio aperture.

4. The improved ribbon microphone of claim 1 wherein:

said upper and lower ribbon retainers include a retainer base and a ribbon clamp.

5. The improved ribbon microphone of claim 4 wherein:

said retainer base includes a clamp slot formed on a top thereof, a first magnet pocket and a second magnet pocket are formed in a bottom of said retainer base, said ribbon opening is formed through said clamp slot, at least one projection extends upward from a top of said retainer base.

6. The improved ribbon microphone of claim 5 wherein:

said ribbon clamp is sized to be received by said clamp slot, said ribbon clamp includes a straight wall and an opposing wall, said opposing wall extends from opposing ends of said straight wall.

7. The improved ribbon microphone of claim 1 wherein:

said first and second line segments are either straight or curved.

8. An improved ribbon microphone, comprising:

a housing tube; and a microphone assembly includes a ribbon transducer, a first magnet, a second magnet, an upper ribbon retainer and a lower ribbon retainer, at least two different pluralities of line segments are pressed into a length of the ribbon transducer, two of said at least two different pluralities of line segments are angled relative to each other, a first plurality of said two different pluralities of line segments extending from a second plurality of second line segments at a middle of said ribbon transducer, said first magnet is positioned on one edge of said ribbon transducer, said second magnet is positioned on an opposing edge of said ribbon transducer, a bottom of said first magnet, said ribbon transducer and said second magnet are retained in said lower ribbon retainer, a top of said first magnet, said ribbon transducer and said second magnet are retained in said upper ribbon retainer, said microphone assembly is retained inside said housing tube.

9. The improved ribbon microphone of claim 8 wherein:

at least one audio aperture is formed through a sidewall of said housing tube.

10. The improved ribbon microphone of claim 9 wherein:

an audio mesh tube is inserted into an inner perimeter of said housing tube to cover said at least one audio aperture.

11. The improved ribbon microphone of claim 8 wherein:

said upper and lower ribbon retainers include a retainer base and a ribbon clamp.

12. The improved ribbon microphone of claim 11 wherein:

said retainer base includes a clamp slot formed on a top thereof, a first magnet pocket and a second magnet pocket are formed in a bottom of said retainer base, said ribbon opening is formed through said clamp slot, at least one projection extends upward from a top of said retainer base.

13. The improved ribbon microphone of claim 12 wherein:

said ribbon clamp is sized to be received by said clamp slot, said ribbon clamp includes a straight wall and an opposing wall, said opposing wall extends from opposing ends of said straight wall.

14. The improved ribbon microphone of claim 8 wherein:

said first and second line segments are either straight or curved.

15. An improved ribbon microphone, comprising:

a housing tube; and a microphone assembly includes a ribbon transducer, a first magnet, a second magnet, a reflector bar, an upper ribbon retainer and a lower ribbon retainer, said first magnet is positioned on one edge of said ribbon transducer, said second magnet is positioned on an opposing edge of said ribbon transducer, said reflector bar is positioned adjacent one side of said ribbon transducer, an opposing side of said ribbon transducer is not obstructed, a bottom of said first magnet, said ribbon transducer, said second magnet and said reflector bar are retained in said lower ribbon retainer, a top of said first magnet, said ribbon transducer, said second magnet and said reflector bar are retained in said upper ribbon retainer, said microphone assembly is retained inside said housing tube.

16. The improved ribbon microphone of claim 15 wherein:

said upper and lower ribbon retainers include a retainer base and a ribbon clamp.

17. The improved ribbon microphone of claim 16 wherein:

said retainer base includes a clamp slot formed on a top thereof, a first magnet pocket, a second magnet pocket and a reflector pocket are formed in a bottom of said retainer base, said ribbon opening is formed through said clamp slot, at least one projection extends upward from a top of said retainer base.

18. The improved ribbon microphone of claim 17 wherein:

said ribbon clamp is sized to be received by said clamp slot, said ribbon clamp includes a straight wall and an opposing wall, said opposing wall extends from opposing ends of said straight wall.

19. An improved ribbon microphone, comprising:

a housing tube; and a microphone assembly includes a ribbon transducer, a first magnet, a second magnet, a reflector bar, an upper ribbon retainer and a lower ribbon retainer, said first magnet is positioned on one edge of said ribbon transducer, said upper and lower ribbon retainers include a retainer base and a ribbon clamp, said second magnet is positioned on an opposing edge of said ribbon transducer, said reflector bar is positioned behind said ribbon transducer, a bottom of said first magnet, said ribbon transducer, said second magnet and said reflector bar are retained in said lower ribbon retainer, a top of said first magnet, said ribbon transducer, said second magnet and said reflector bar are retained in said upper ribbon retainer, said microphone assembly is retained inside said housing tube, a top end cap engages said upper ribbon retainer, said top end cap is secured to said housing tube.

20. The improved ribbon microphone of claim 16, further comprising:

a bottom end cap engages said lower ribbon retainer, said bottom cap is secured to said housing tube.

* * * * *